US007029407B2

(12) United States Patent
Lee et al.

(10) Patent No.: US 7,029,407 B2
(45) Date of Patent: Apr. 18, 2006

(54) GAME BALL COVER WITH IMPROVED STRIPES AND/OR LOGOS

(75) Inventors: Ming Hsin Lee, Taipei (TW); Douglas G. Guenther, Wheaton, IL (US); Kevin L. Krysiak, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/325,421

(22) Filed: Dec. 20, 2002

(65) Prior Publication Data

US 2004/0121865 A1 Jun. 24, 2004

(51) Int. Cl.
*A63B 41/08* (2006.01)

(52) U.S. Cl. ..... 473/597; 473/599; 473/603

(58) Field of Classification Search ..... 473/595, 473/596, 597, 599, 603, 604, 605, 615, 574; 40/327

See application file for complete search history.

(56) References Cited

U.S. PATENT DOCUMENTS

| | | | | | |
|---|---|---|---|---|---|
| 1,487,658 | A | | 3/1924 | Jensen | |
| 1,559,117 | A | * | 10/1925 | Maynard | 473/596 |
| 1,931,429 | A | * | 10/1933 | Buckner et al. | 473/596 |
| 2,011,760 | A | * | 8/1935 | Gallinant | 473/596 |
| 2,182,053 | A | | 12/1939 | Reach | |
| 2,448,731 | A | * | 9/1948 | Park | 473/596 |
| 4,515,852 | A | | 5/1985 | Katabe et al. | |
| 4,822,041 | A | | 4/1989 | Molitor | |
| 4,867,452 | A | | 9/1989 | Finley | |
| 4,869,504 | A | | 9/1989 | Kralik | |
| 4,928,962 | A | | 5/1990 | Finley | |
| 5,098,097 | A | | 3/1992 | Kennedy et al. | |
| 5,127,648 | A | | 7/1992 | Mallick | |
| 5,133,550 | A | | 7/1992 | Handy | |
| 5,183,263 | A | | 2/1993 | Kuebler | |
| 5,228,687 | A | | 7/1993 | Luecke et al. | |
| 5,383,660 | A | | 1/1995 | Adler et al. | |
| 5,451,046 | A | | 9/1995 | Batton | |
| 5,577,724 | A | | 11/1996 | Gandolfo | |
| 5,681,233 | A | | 10/1997 | Guenther et al. | 473/605 |
| 5,888,157 | A | | 3/1999 | Guenther et al. | 473/604 |
| 5,931,752 | A | | 8/1999 | Guenther et al. | 473/597 |
| 5,941,785 | A | | 8/1999 | Bartels | 473/597 |
| 5,984,812 | A | * | 11/1999 | Sassak | 473/596 |
| 6,200,239 | B1 | * | 3/2001 | Kennedy et al. | 473/604 |
| 6,634,970 | B1 | * | 10/2003 | Jiminez | 473/597 |

* cited by examiner

*Primary Examiner*—Steven Wong
(74) *Attorney, Agent, or Firm*—Terence P. O'Brien

(57) ABSTRACT

An inflatable game ball including a carcass, a cover and at least one thin member. The cover has inner and outer surfaces. The inner surface of the cover is coupled to the carcass. At least one recess is formed into the outer surface of the cover. At least one thin member is coupled to the cover at the at least one recess. The member substantially fills the recess. The member has inner and outer portions. The outer portion is formed of a highly gripable material.

26 Claims, 7 Drawing Sheets

GAME BALL COVER WITH IMPROVED STRIPES AND/OR LOGOS

FIELD OF THE INVENTION

The present invention relates generally to a game ball. In particular, the present invention relates to a game ball including a cover having at least one recessed portion and laid-in material coupled to the cover at the recessed portion.

BACKGROUND OF THE INVENTION

Inflatable game balls, such as footballs, basketballs, volleyballs and soccer balls, are well known and typically include an inner inflatable air bladder and an outer cover. The cover can be formed of one or more cover panels. Many footballs include covers with stripes. In fact, many organized football associations, such as the National Collegiate Athletic Association ("NCAA®") and many state high school athletic associations, require stripes on their footballs. In particular, the NCAA® requires footballs to include two 1-inch white stripes that are three to three and one-quarter inches from the end of the ball and are located only on the two cover panels adjacent to the laces. The outer cover of footballs and other types of game balls also typically include trademarks, symbols and logos. The stripes, trademarks, logos and/or symbols on game balls can extend over a significant percentage of the outer surface area of the ball.

In football and basketball, as in many other sports, the gripping and tactile characteristics of the ball can considerably affect the performance of the participating players. In particular, the tactile characteristics of the outer surface of the game ball significantly effect the player's ability to catch, pass or otherwise control the ball accurately and reliably.

Football stripes are commonly applied by painting or transferring on a thin layer of paint, dye or other coating. These stripes typically have a smooth and slick outer surface which, particularly in inclement weather, can negatively affect the players ability to catch, pass and otherwise control the ball. Many painted on or transferred on stripes are also susceptible to peeling and can wear easily. As a result, the appearance of many striped footballs overtime can be negatively affected by stripes that have partially worn or flaked off. Even premium game balls using striping material that is less slick and more durable than typical striping material, result in stripes with outer surfaces that have lower tactility than the other portions of the ball. Logos, trademarks and other symbols commonly applied to the outer surface of game balls also can have a smooth, slick outer surface and can flake or wear away easily.

Thus, there is a need for football stripes that have improved gripping and tactile characteristics without deviating or radically departing from the ball's traditional design and organized play equipment requirements. What is needed is football stripes that improves a player's ability to pass, catch or otherwise control a ball, particularly during inclement weather. Further, it would be advantageous to provide football stripes, or game ball logos, trademarks or symbols that are more durable and peel resistant. It would also be advantageous to provide game ball logos, trademarks and/or symbols, which improve the gripping and tactile characteristics of the game ball.

SUMMARY OF THE INVENTION

The present invention provides an inflatable game ball including a carcass, a cover and at least one thin member. The cover has inner and outer surfaces. The inner surface of the cover is coupled to the carcass. At least one recess is formed into the outer surface of the cover. At least one thin member is coupled to the cover at the at least one recess. The member substantially fills the recess. The member has inner and outer portions. The outer portion is formed of a highly gripable material.

According to a principal aspect of a preferred form of the invention, an inflatable football includes a cover and at least first and second stripes. The cover has an outer surface. At least first and second recesses are formed into the outer surface of the cover. The first and second stripes are coupled to the cover at the first and second recesses, respectively. The first and second stripes substantially fill the first and second recesses, respectively. Each of the first and second stripes has inner and outer portions. The outer portion of each of the first and second stripes is formed of an outer material that is compressible, resilient and tactile.

According to another preferred aspect of the invention a football includes a cover having an outer surface formed of a first material and at least first and second stripes coupled to the cover. Each of the first and second stripes has an outer surface formed of a second material. The second material has greater tactility than the first material such that the outer surface of the first and second stripes is more easily grippable than the outer surface of the cover.

According to another preferred aspect of the invention provides a method of manufacturing an inflatable game ball. The method includes the steps of obtaining a carcass, obtaining a cover having inner and outer surfaces, forming at least one recess into the outer surface of the cover, coupling the inner surface of the cover to the carcass, and substantially filling the recess with a thin member having an outer portion formed of an outer material that is compressible, resilient, and tactile.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
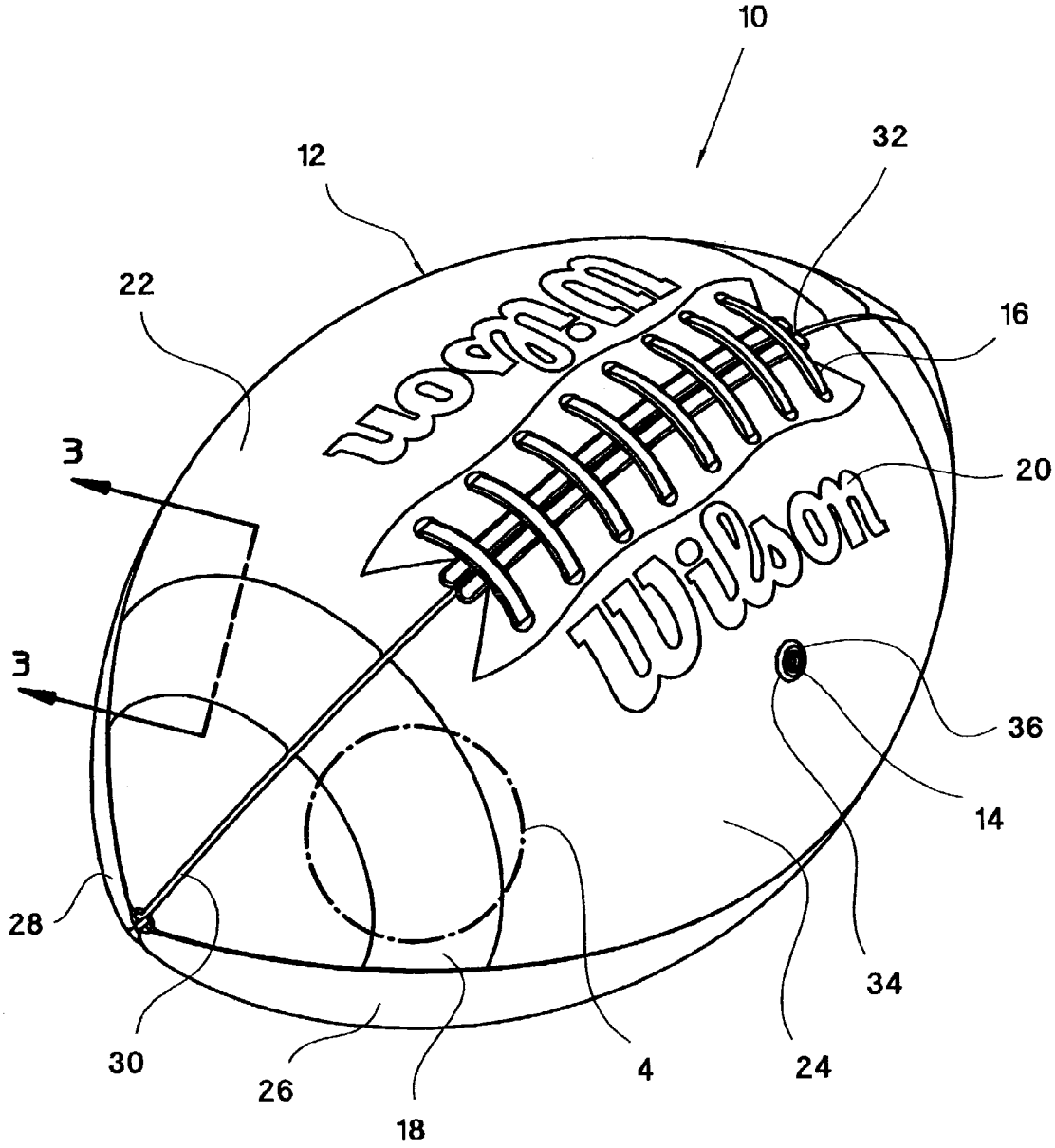
FIG. 1 is a top perspective view of an American football in accordance with a preferred embodiment of the present invention.

Referring to FIG. 1, an American football is indicated generally at 10. The football 10 is one example of an inflatable game ball. The present invention is directly applicable to other inflatable games, such as, for example, basketballs, volleyballs, soccer balls and rugby balls.

The football 10 is a generally prolate spheroidal shaped inflatable object having a major longitudinal dimension and a minor transverse dimension. The football 10 includes, a cover 12, a bladder 14, a lacing 16, four stripes 18 and a plurality of logos 20. The cover 12 is a prolate spheroidal shaped outer body preferably formed from first, second, third and fourth cover panels 22, 24, 26 and 28 that are joined to one another along longitudinal seams 30. The longitudinal seam 30 connecting the first and second cover panels 22 and 24 includes a longitudinally extending slot 32. The second cover panel 24 includes a valve aperture 34. In alternative preferred embodiments, the cover 12 can be formed of a single piece or of two, three, five or other numbers of cover panels. The cover 12 provides the ball 10 with a durable and grippable outer surface. The cover 12 is typically made of leather, rubber or a synthetic polymeric plastic material. An outer surface of the cover 12 preferably includes a pebbled texture for enhancing the grip and improving the aesthetics of the football 10.

Figure 2:
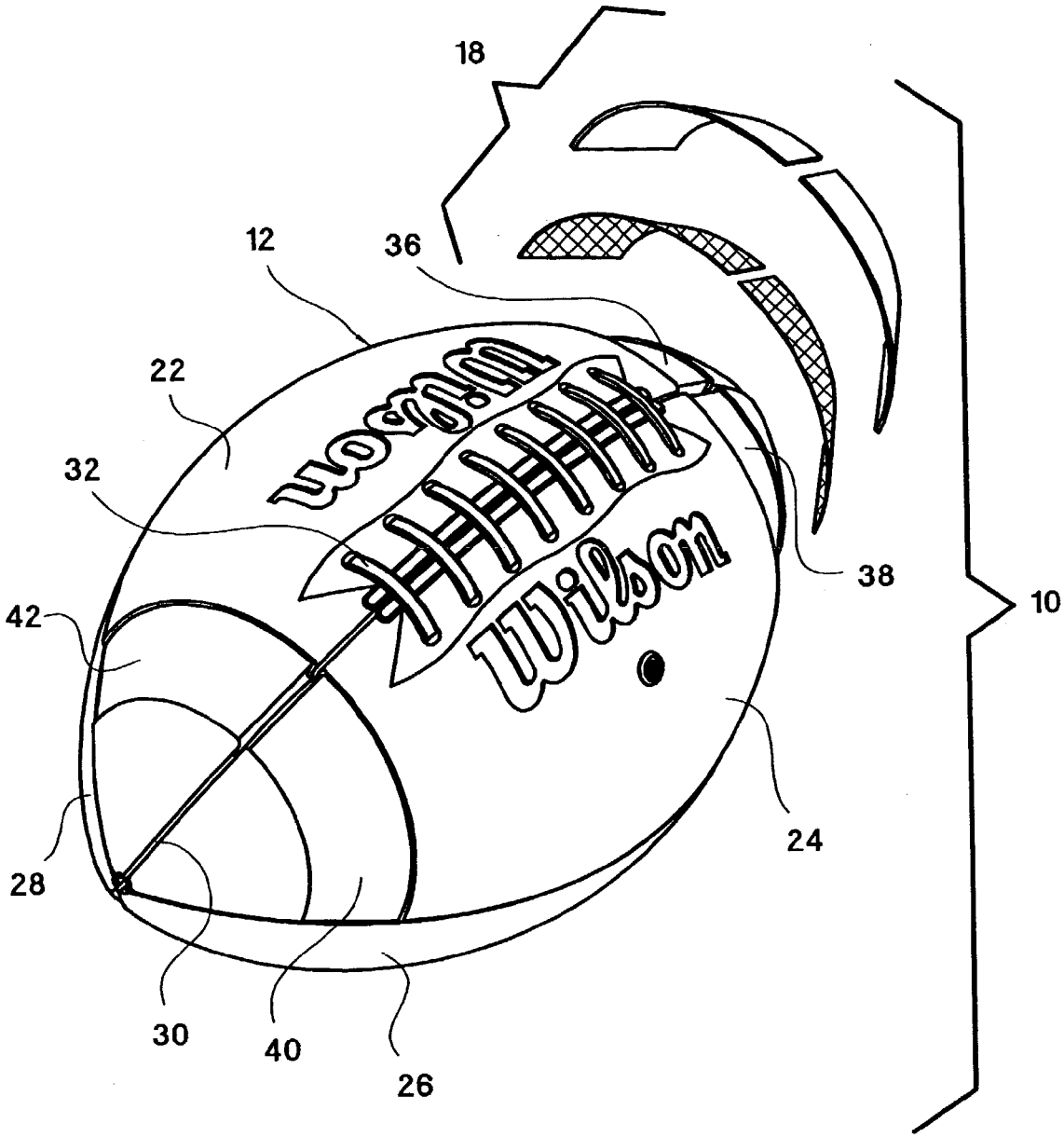
FIG. 2 is a top, partially exploded, perspective view of the football of FIG. 1.

Referring to FIG. 2, first, second, third and fourth stripe recesses 36, 38, 40 and 42 are formed into the first and second cover panels 22 and 24. The recesses 36, 38, 40 and 42 are preferably formed by embossing or pressing the cover panels 22 and 24 to produce the recesses 36, 38, 40 and 42. By embossing or pressing the cover panels to form the strip recesses, no cover panel material is removed, rather, the cover panels are simply compressed under heat and/or pressure to produce the recesses. Embossing or pressing the cover panels enables the cover panels to retain their strength, structural integrity and durability. The recesses 36, 38, 40 and 42 inwardly extend into the cover panels 22 and 24 from an outer surface of the cover panels 22 and 24. The recesses 36, 38, 40 and 42 preferably are formed with a depth within the range of 0.2 to 2.0 millimeters. In a particularly preferred embodiment, the depth of the recesses 36, 38, 40 and 42 is within the range of 0.5 to 1.0 millimeters. In yet another particularly preferred embodiment, the recesses have a depth within the range of 0.65 to 0.8 millimeters.

The stripe recesses 36, 38, 40 and 42 can be positioned at any position about the cover panels and can have any width or length dimension. Preferably, the position, width and length of the stripe recesses 36, 38, 40 and 42 are located and sized in accordance with stripe requirements of a particular athletic association requirement. For example, the NCAA® requires two 1-inch white stripes that are three to three and one-quarter inches from the end of the ball and are located only on the two cover panels adjacent to the laces. Therefore, the stripe recesses can be positioned and sized to correspond with the NCAA® stripe requirements. Alternatively, the stripe recesses can be positioned and sized to match the stripe requirements of other organizations, such as state high school athletic associations.

In alternative preferred embodiments, the stripe recesses can be formed on any one or more of the cover panels 22, 24, 26 and 28. In another alternative embodiment, the stripe recesses can be formed by milling, stripping or otherwise removing material from the outer surface of the cover panel to form the recess.

Referring to FIG. 1, the bladder 14 is an inflatable air tube preferably having a prolate spheroidal shape. The bladder 14 is inserted into the cover 12 through the slot 32. The bladder 14 includes a valve 36 that extends through the valve aperture 34 of the cover 12 for access by a user.

The lacing 16 retains is used to secure the first and second cover panels 22 and 24 and to close the slot 32. The lacing 16 also provides raised surfaces for a player to contact when passing, catching or holding onto the football 10.

Referring to FIG. 2, the stripe 18 is an elongate thin member sized and positioned to substantially fill one of the stripe recesses 36, 38, 40 and 42. The stripes 18 are also preferably positioned and sized to match the position and size of the strip recesses. In a particularly preferred embodiment, the stripes 18 are sized to meet a specific association or organization requirements for stripes, such as, for example, the NCAA® and state high school associations. The stripes 18 are preferably formed with a thickness within the range of 0.2 to 2.0 millimeters. In a particularly preferred embodiment, the thickness of the stripes is within the range of 0.5 to 1.0 millimeters. In yet another particularly preferred embodiment, the thickness of the stripes 18 is within the range of 0.65 to 0.8 millimeters. In another preferred embodiment, the thickness of the stripe 18 can be selected to substantially fill and slightly outwardly extend from cover panel.

Each stripe 18 is permanently attached to one of the cover panels 22 and 24. Preferably, the stripe is attached to one of the cover panels through adhesive bonding, thermal bonding, chemical bonding, stitching, sewing, press-fitting, and combinations thereof. In a particularly preferred embodiment, the stripe 18 is attached to the cover panel by stitching, or sewing, and adhesive bonding. An adhesive is applied to one or both of the inner surface of the stripe 18 and the exposed surface of the stripe recess. The stripe 18 is stitched or sewn at each end adjacent to the respective longitudinal seam 30. In an alternative preferred embodiment, the stripe 18 can be applied to the stripe recess in a liquid state and then allowed to cure.

In a preferred embodiment, the stripe 18 includes outer and inner portions 44 and 46. The outer portion 44 is formed of a compressible, resilient and tactile material, preferably, a polyurethane. In alternative preferred embodiments, the outer portion 44 can be formed of other materials, such as, for example, a polyvinylchloride, a rubber, a leather, a synthetic leather, an elastomer and combinations thereof. The outer portion 44 is preferably formed in a white color. Alternatively, the outer portion 44 can be formed in any other color or color combination. In a preferred embodiment, the tactile characteristics of the outer portion 44 of the stripe 18 are greater than or equal to the tactile characteristics of outer surface of the cover 12 or the cover panels 22, 24, 26 and 28. In one particularly preferred embodiment, the outer portion 44 of the stripe 18 is formed of a polyurethane or other highly grippable material and is used on a ball 10 having a leather, composite leather, or a synthetic leather material with less tactility.

The inner portion 46 of the stripe 46 is a backing layer configured to strengthen and facilitate attachment of the stripe to the cover 12. The inner portion 44 is fixedly connected to the outer portion through bonding, impregnation, or other conventional means. The inner portion 46 is preferably formed of a strong, tear resistant material, such as, a woven or unwoven fabric. The fabric of the inner portion 46 can be impregnated with a polymer, such as a latex.

The outer portion 44 of the stripe 18 improves the overall feel of the stripes and the ball, and increases the frictional interaction between the stripe 18 and the hands of the player. This increased frictional interaction enables the stripe 18 to improve or increase the gripability or tactility of the football 10, thereby improving a player's ability to pass, catch, hold on to, and otherwise control the ball 10, particularly in inclement weather. The stripe 18 of the present invention eliminates the smooth and slick outer surface of the stripe present on many existing balls. The stripe 18 is also more durable, more wear resistant and less susceptible to peeling than conventional football stripes. The stripe 18 is configured to withstand the stresses encountered during normal use without peeling or significantly wearing, and to improve the overall feel of the stripe 18 and the ball 10 to the user. Additionally, the stripe 18 of the present invention improves the feel and playability of the ball without deviating from the traditional look of a game ball or the football requirements of athletic associations.

Figure 3:
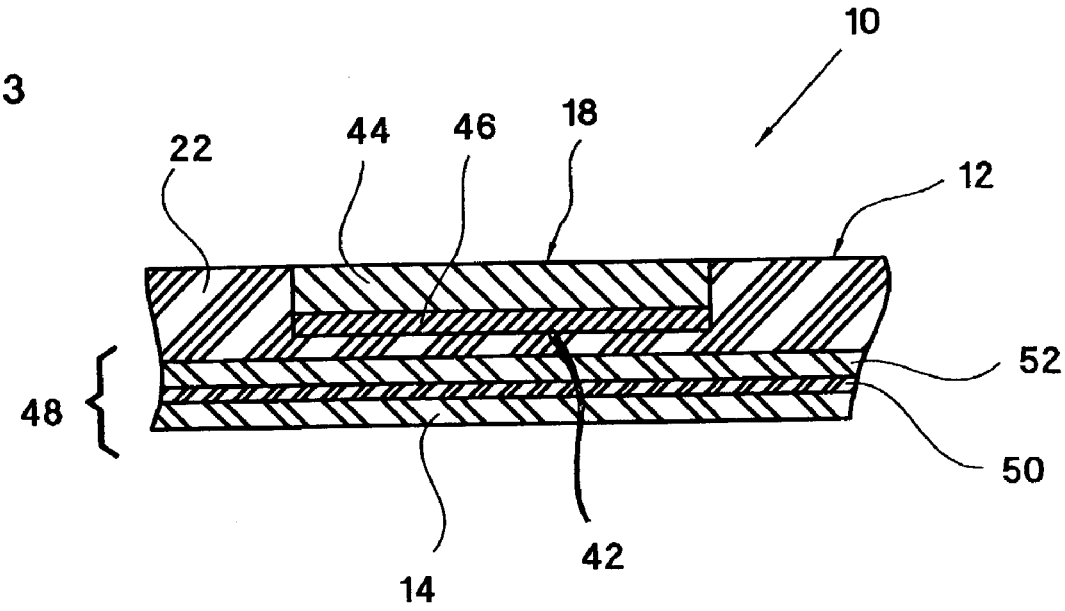
FIG. 3 is a sectional of the football taken along lines 3—3 of FIG. 1.

FIG. 3 illustrates the football 10 in greater detail. The football 10 is a multi-layered structure preferably including a carcass 48 and the cover 12. In one preferred embodiment, the carcass 48 includes the bladder 14, a windings layer 50 and a padding layer 52. The carcass 48 enables the football 10 to retain its desired shape, and a predetermined amount of air thereby achieving the desired firmness to the football 10. The carcass 48 also improves the strength, reliability and feel of the ball 10. In alternative preferred embodiments, the carcass can include other combinations of materials and layers. The stripe recess 42 (or stripe recesses 36, 38 or 40) preferably has a U-shaped cross-section for receiving the stripe 18. In alternative, preferred embodiments, the stripe recess can take other cross-sectional shapes, such as for example, polygonal, arcuate, irregular and combinations thereof.

The stripe 18 substantially fills the stripe recess 42. In an alternative preferred embodiment, the stripe 18 can partially fill the recess thereby providing a recessed outer surface. In another alternative preferred embodiment, the stripe 18 can fill the recess and slightly outwardly extend from the recess thereby providing a raised stripe look and feel to the ball.

Figure 4:
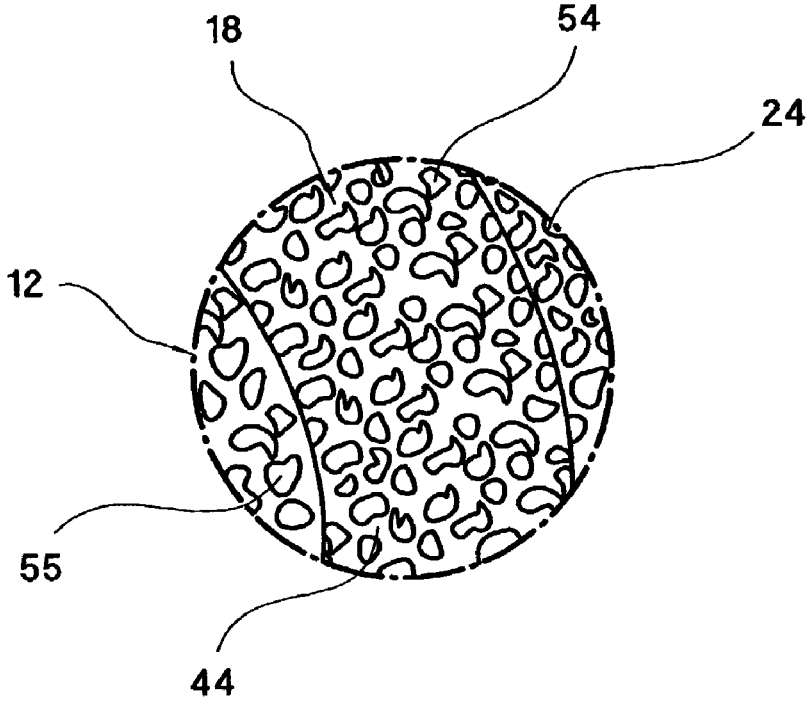
FIG. 4 is a top view of a portion of the outer surface of the football within the circle 4 of FIG. 1.
Figure 5:
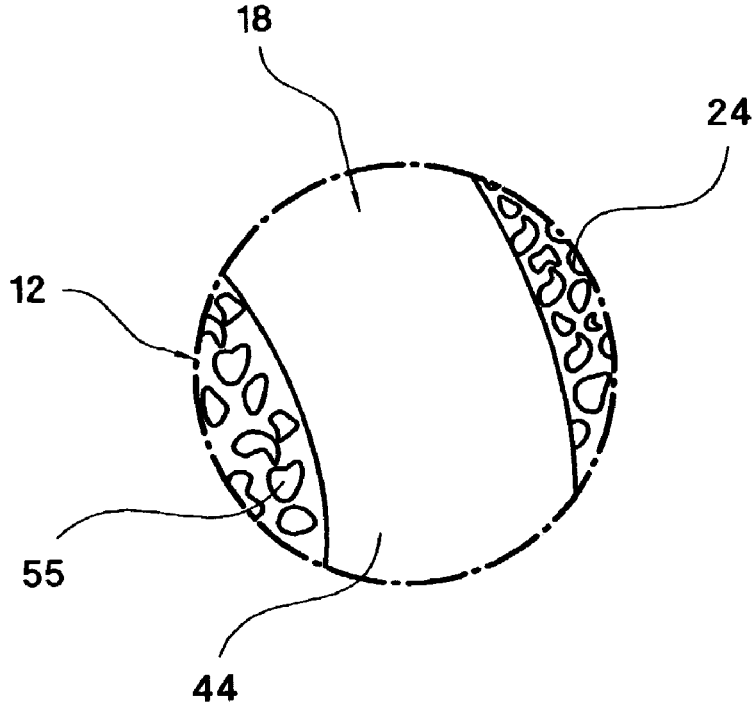
FIG. 5 is a top view of a portion of the outer surface of a football in accordance with an alternative preferred embodiment of the present invention.

FIG. 4 illustrates the cover 12 and the stripe 18 in greater detail. In a preferred embodiment, the outer surface of the outer portion 44 of the stripe 18 has a pebbled texture including a plurality of pebble-like projections 54. The outer surface of the cover 12 also preferably includes a pebbled texture and a plurality of pebble-like projections 55, which are substantially similar to the pebble-like projections 54 of the stripe 18. The pebble-like projections 54 provide the outer surface of the stripe 18 with a pebbled texture that is substantially similar to the grip enhancing pebbled outer surface present on the cover 12 of conventional footballs and basketballs. The pebble-like projections 54 are preferably convex, rounded and spaced apart from one another. The pebble-like projections 54 further improve the player's ability to grip the football 10. In an alternative preferred embodiment, the outer surface 52 of the stripe 18 can include a plurality of concave pebble-like projections. Referring to FIG. 5, in an alternative preferred embodiment, the outer surface of the stripe 18 can be generally smooth and free of pebble-like projections. In other embodiments, the outer surface 52 can be cross-hatched, grainy, grooved or otherwise irregular to roughen the texture of the outer surface of the stripe 18.

Figure 6:
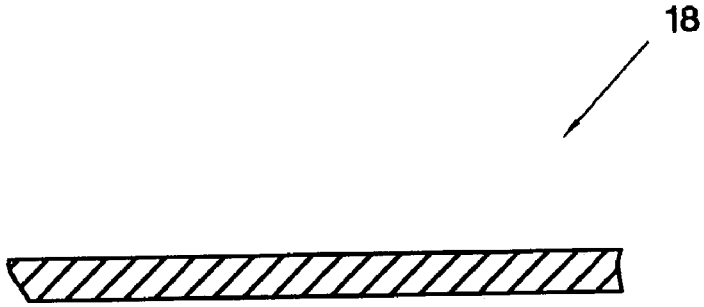
FIG. 6 is a sectional view of a football stripe in accordance with an alternative preferred embodiment of the present invention.
Figure 7:
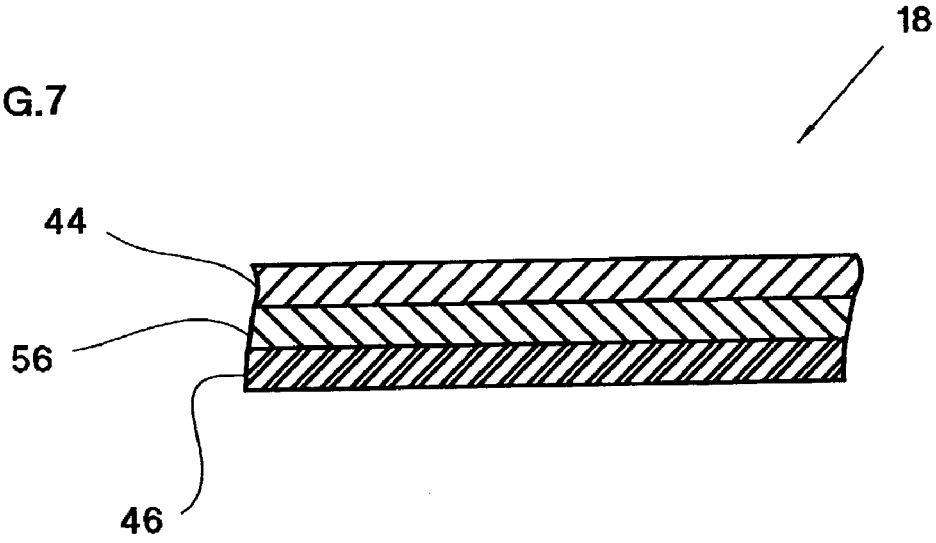
FIG. 7 is a sectional view of a football stripe in accordance with another alternative preferred embodiment of the present invention.

Referring to FIGS. 6 and 7, alternative preferred embodiments of the stripe 18 are illustrated. FIG. 6 illustrates one preferred alternative embodiment, wherein the stripe 18 is formed of one continuous material. The material is substantially similar to the materials used for the outer portion 44 of the stripe 18 discussed above. Referring to FIG. 7, another alternative preferred embodiment of the stripe 18 is illustrated. The stripe 18 can be multi-layered with the outer and inner portions 44 and 46, as discussed above separated by an intermediate layer 56. The intermediate layer can be formed of any suitable material. The material of the intermediate layer 56 can vary from one ball to the next depending upon the desired characteristics of the stripe (compressibility, durability, softness, etc.).

Figure 8:
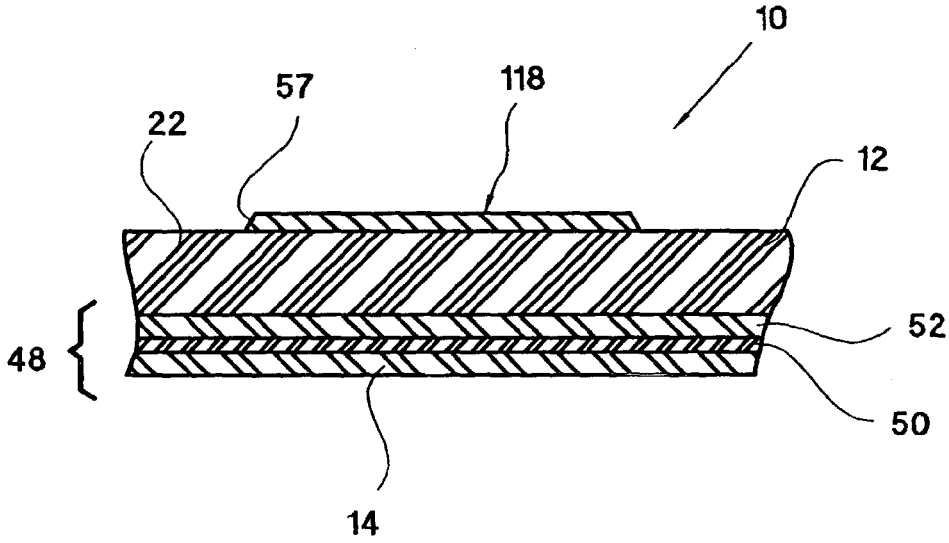
FIG. 8 is a sectional view of a football in accordance with another alternative preferred embodiment of the present invention.

Referring to FIG. 8, an alternative preferred embodiment of the stripe 18 applied to the cover panel 22 is illustrated. In this embodiment, a stripe 18 is attached directly to the outer surface of a portion of the cover 12 or one of the cover panels 22, 24, 26 or 28. The stripe 118 is substantially similar to the stripe 18 described above. The stripe 118 can be attached to the cover and cover panel by chemical, thermal, or mechanical bonding, stitching, sewing or other conventional means. The stripe 118 can be formed of the same materials as the stripe 18. The stripe 118 is shown as being formed of a single continuous material, alternatively, the stripe 118 can include a backing or multiple layers. The outer surface of the stripe 118 can be pebbled, smooth or have other outer surface configurations such as those described above for the stripe 18. The portion of the cover 12 or cover panel contacting the stripe is not recessed. As such the stripe 118 outwardly extends from outer surface of the cover 12 or cover panel 22. Each side of the stripe 118 preferably includes a tapered edge 57 in order to eliminate a shape raised corner edge.

The outer surface of the stripe 118 is preferably made of a material that is more tactile, or has greater tactility, than the material the outer surface of the cover 12 or cover panel. In other words, the material of the outer surface of stripe 118 is preferably formed of a material that is more grippable than the material of the outer surface of the cover 12 or the cover panel. For example, the cover panel or cover 12 can be formed of a leather and the stripe 118 can be formed of a polyurethane. The stripes 118 are preferably formed with a thickness within the range of 0.2 to 2.0 millimeters. In a particularly preferred embodiment, the thickness of the stripes 118 is within the range of 0.5 to 1.0 millimeters. In yet another particularly preferred embodiment, the thickness of the stripes 118 is within the range of 0.65 to 0.8 millimeters.

Figure 9:
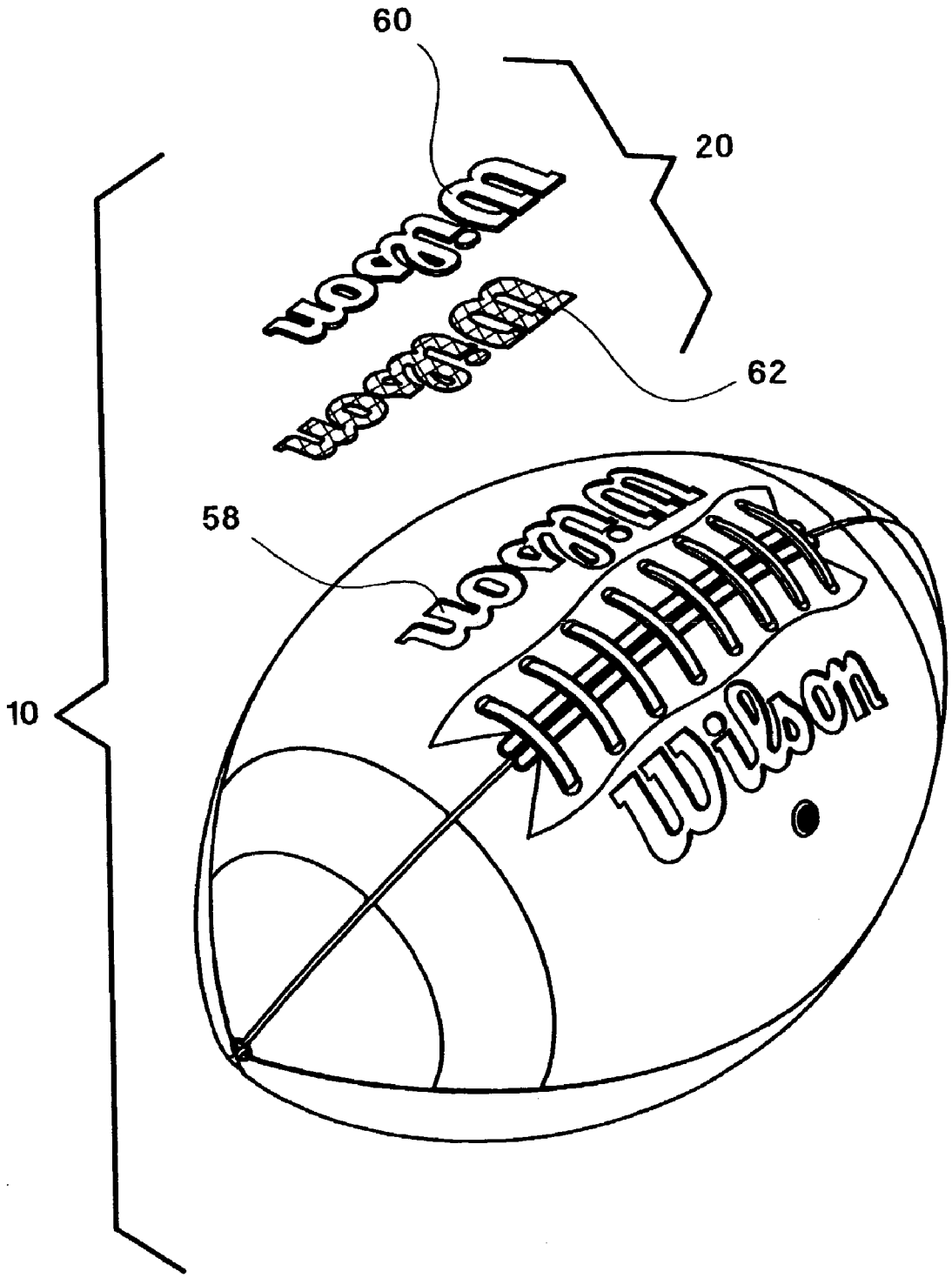
FIG. 9 is a top, partially exploded, perspective view of the football of FIG. 1.
Figure 10:
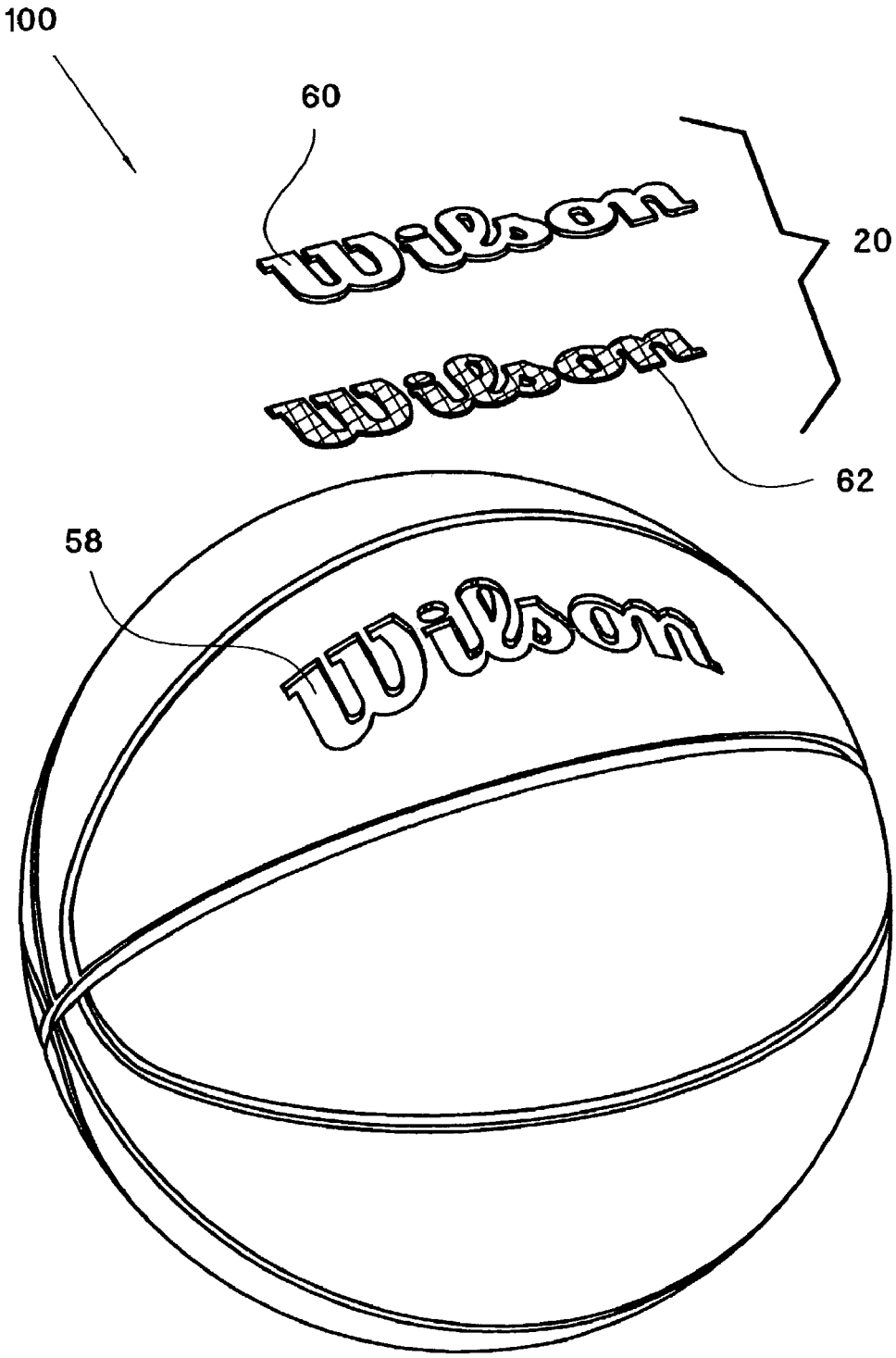
FIG. 10 is a partially exploded, perspective view of a basketball in accordance with another preferred embodiment of the present invention.

Referring to FIGS. 9 and 10, the present invention is also applicable to logos, trademarks or symbols applied to a game ball, such as, for example, the "Wilson" logo and trademark 20. The game ball can be a football, a basketball or any other type of game ball. In a preferred embodiment, the cover 12 includes a logo recess 58. The logo recess 58 is produced and has similar depth limitations as the stripe recesses 36, 38, 40 and 42 described above. The logo recess 58 is positioned at a desired position(s) on the cover 12 and is formed to generally correspond to the shape of the logo 20 or any other desired logo, trademark or symbol.

The logo 20 is preferably similar to the stripe 18 discussed above. In a preferred embodiment the logo 20 includes outer and inner portions 60 and 62, which are similar in construction and operation to the outer and inner portions 44 and 46 of the stripe 18. The logo 20 can be single or multi-colored, and can be representative of any alpha-numeric or graphical image. The outer surface of the outer portion 60 of the logo 20 can be smooth, pebbled or have other types of three dimensional outer surface configuration. The logo 20 is preferably connected to the cover 12 at the secondary recess 58 in a manner similar to the connection of the stripe 18 to the stripe recess 42.

The game ball 10 can be formed by first obtaining the cover 12 formed of one or more cover panels. The stripe recesses 42 and/or logo recesses 58 are then formed into the outer surface of the cover or cover panel. In a preferred embodiment, the recesses 42 and 58 are formed by embossing or pressing the outer surface of the cover. The cover or cover panel may have a pebbled texture before the formation of the recesses through embossing or pressing. In alternative preferred embodiments, the recesses 42 and 58 can be formed by milling, stripping or other conventional means for removing material. The stripe 18 and/or logo 20 is laid-in to the corresponding recess 42 or 58 and secured through adhesive bonding, thermal bonding, chemical bonding, stitching, sewing, press-fitting and combinations thereof. If the cover 12 is formed of two or more cover panels, the cover panels can be connected together through stitching or other means, and the cover is then positioned about the carcass.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. An inflatable game ball comprising:

a carcass;

a cover having inner and outer surfaces, the inner surface of the cover coupled to the carcass, at least one recess formed into the outer surface of the cover, each recess extending over only a portion of the circumference of the game ball; and at least one thin sheet-like member fixedly coupled to the cover at the at least one recess, the member substantially filling the recess, the member having inner and outer portions, the outer portion being formed of a compressible, resilient material that is highly grippable when directly contacted by a user's hands, the frictional interaction between the outer portion of the member and the user's hands being greater than or equal to the frictional interaction between the outer surface of the cover and the user's hands.

2. The game ball of claim 1, wherein the game ball is selected from the group consisting of a football, a basketball, a volleyball, a soccer ball and a rugby ball.

3. The game ball of claim 1, wherein the highly gripable material of the outer portion of the member is selected from a group consisting of a polyurethane, a polyvinylchloride, a rubber, a leather, a synthetic leather, an elastomer and combinations thereof.

4. The game ball of claim 1, wherein the inner portion of the member is a backing layer.

5. The game ball of claim 1, wherein the outer portion includes an exposed surface having a pebbled texture.

6. The game ball of claim 1, wherein the recess has a depth between the range of 0.2 to 2.0 millimeters.

7. The game ball of claim 1, wherein the recess has a depth between the range of 0.5 to 1.0 millimeters.

8. The game ball of claim 1, wherein the member has a thickness between the range of 0.2 to 2.0 millimeters.

9. The game ball of claim 1, wherein the member has a thickness between the range of 0.5 to 1.0 millimeters.

10. The game ball of claim 1, wherein the member is coupled to the cover at the recess in a method selected from the group consisting of adhesively bonded, thermally bonded, chemically bonded, stitched, sewn, press-fit, and combinations thereof.

11. The game ball of claim 1, wherein the recess is formed to generally resemble a shape selected from the group consisting of a logo, a stripe, a symbol and a trademark.

12. The game ball of claim 11, wherein the member is formed to generally correspond to the shape of the recess and is selected from the group consisting of a logo, a stripe, a symbol and a trademark.

13. The game ball of claim 1, wherein the member has a thickness that is greater than the depth of the recess such that the member substantially fills, and outwardly extends from, the recess.

14. An inflatable football comprising:

a cover having an outer surface, at least first and second recesses formed into the outer surface of the cover, each recess extending over less than 360 degrees around the game ball, each recess having a depth within the range of 0.2 to 2.0 millimeters; and at least first and second stripes fixedly coupled to the cover at the first and second recesses, respectively, the first and second stripes substantially filling the first and second recesses, respectively, each of the first and second stripes having inner and outer portions, the outer portion of each of the first and second stripes being formed of an outer material that is compressible, resilient, and tactile when directly contacted by the hands of a user, the frictional interaction between the outer portion the stripes and the user's hands being greater than or equal to the frictional interaction between the outer surface of the cover and the user's hands.

15. The football of claim 14, wherein the cover includes a plurality of cover panels, and wherein at least one of the cover panels has the first and second recesses.

16. The football of claim 15, wherein the cover includes first, second, third and fourth cover panels, wherein each of the first and second cover panels includes first and second recesses, wherein the at least first and second stripes include first, second, third and fourth stripes, and wherein the first, second, third and fourth stripes substantially fill the first and second recesses of the first and second cover panels, respectively.

17. The football of claim 14, wherein the highly gripable material of the outer portion of the member is selected from a group consisting of a polyurethane, a polyvinylchloride, a rubber, a leather, a synthetic leather, an elastomer and combinations thereof.

18. The football of claim 14, wherein the inner portion of the stripe is a backing layer.

19. The football of claim 14, wherein the inner and outer portions are formed of substantially the same material.

20. The football of claim 14, wherein the outer portion includes an exposed surface having a pebbled texture.

21. The football of claim 14, wherein the recess has a depth between the range of 0.5 to 1.0 millimeters.

22. The football of claim 14, wherein the stripe has a thickness between the range of 0.2 to 2.0 millimeters.

23. The football of claim 14, wherein the stripe has a thickness between the range of 0.5 to 1.0 millimeters.

24. The football of claim 14, wherein the member is coupled to the cover at the recess in a method selected from the group consisting of adhesively bonded, thermally bonded, chemically bonded, stitched, sewn, press-fit, and combinations thereof.

25. The football of claim 1, wherein the frictional interaction between the outer portion the member and the user's hands is greater than the frictional interaction between the outer surface of the cover and the user's hands.

26. The football of claim 14, wherein the frictional interaction between the outer portion the stripes and the user's hands is greater than the frictional interaction between the outer surface of the cover and the user's hands.

* * * * *